US006988475B2

(12) United States Patent
Burke

(10) Patent No.: US 6,988,475 B2
(45) Date of Patent: Jan. 24, 2006

(54) METHODS FOR STARTING AN INTERNAL COMBUSTION ENGINE

(75) Inventor: James O. Burke, Richmond, IL (US)

(73) Assignee: Kold Ban International, Ltd., Lake in the Hills, IL (US)

( * ) Notice: Subject to any disclaimer, the term of this patent is extended or adjusted under 35 U.S.C. 154(b) by 0 days.

(21) Appl. No.: 10/797,638

(22) Filed: Mar. 10, 2004

(65) Prior Publication Data

US 2004/0261743 A1 Dec. 30, 2004

Related U.S. Application Data

(63) Continuation of application No. 10/278,524, filed on Oct. 23, 2002, now abandoned, which is a continuation of application No. 09/652,686, filed on Aug. 31, 2000, now abandoned.

(51) Int. Cl.
*F02N 11/12* (2006.01)

(52) U.S. Cl. ..... 123/179.28; 320/105

(58) Field of Classification Search ..... 123/179.1, 123/179.3, 179.28, 198 R; 290/50, 38 R; 307/10.6; 320/104, 105
See application file for complete search history.

(56) References Cited

U.S. PATENT DOCUMENTS

| | | | |
|---|---|---|---|
| 2,659,042 | A | 11/1953 | Anderson et al. |
| 3,638,108 | A | 1/1972 | Channing |
| 3,942,027 | A | 3/1976 | Fima |
| 4,161,682 | A | 7/1979 | Corvette |
| 4,488,147 | A | 12/1984 | Signorile |
| 4,492,912 | A | 1/1985 | Nowakowski |
| 4,494,162 | A | 1/1985 | Eyler |
| 4,510,431 | A | 4/1985 | Winkler |
| 4,540,929 | A | 9/1985 | Binkley |
| 4,727,306 | A | 2/1988 | Misak et al. |
| 4,857,820 | A | 8/1989 | Tompkins et al. |
| 4,902,955 | A | 2/1990 | Manis et al. |
| 5,039,930 | A | 8/1991 | Collier et al. |
| 5,077,513 | A | 12/1991 | Dea et al. |

(Continued)

FOREIGN PATENT DOCUMENTS

| | | |
|---|---|---|
| JP | 2-175351 | 7/1990 |

OTHER PUBLICATIONS

U.S. Appl. No. 60/292,791, filed May 22, 2001, entitled "Vehicle With Switched Energy Storage System For Engine Cranking".

(Continued)

*Primary Examiner*—Andrew M. Dolinar
(74) *Attorney, Agent, or Firm*—Brinks Hofer Gilson & Lione

(57) ABSTRACT

A method for starting an internal combustion engine coupled with a cranking motor, which is coupled with an electrical battery, includes connecting a capacitor with an electrical system of another engine or battery, wherein the capacitor is disconnected from the cranking motor coupled with the first engine, and charging the capacitor with the electrical system of the other engine or battery. The method further includes connecting the capacitor with the cranking motor coupled with the first engine, at a time when the first battery has insufficient charge to start the first engine, and starting the first engine with the cranking motor and the capacitor. A portable rapid-delivery power supply apparatus for providing a supplementary source of power to an electrical system includes a capacitor having connectors adapted to be connected to the electrical system and a charging device coupled to the capacitor, wherein the charger is powered by alternating current.

14 Claims, 4 Drawing Sheets

U.S. PATENT DOCUMENTS

| | | | | |
|---|---|---|---|---|
| 5,146,095 | A | | 9/1992 | Tsuchiya et al. |
| 5,155,373 | A | | 10/1992 | Tsuchiya et al. |
| 5,157,267 | A | | 10/1992 | Shirata et al. |
| H1172 | H | | 4/1993 | Gorniak |
| 5,207,194 | A | | 5/1993 | Clerici |
| 5,260,637 | A | | 11/1993 | Pizzi |
| 5,321,389 | A | | 6/1994 | Meister |
| 5,371,455 | A | | 12/1994 | Chen |
| 5,563,454 | A | | 10/1996 | Araki et al. |
| 5,589,292 | A | | 12/1996 | Rozon |
| 5,637,978 | A | | 6/1997 | Kellet et al. |
| 5,642,696 | A | | 7/1997 | Matsui |
| 5,783,872 | A | | 7/1998 | Blair |
| 5,793,185 | A | | 8/1998 | Prelec et al. |
| 5,818,115 | A | | 10/1998 | Nagao |
| 5,925,938 | A | | 7/1999 | Tamor |
| 5,963,417 | A | | 10/1999 | Anderson et al. |
| 5,998,961 | A | | 12/1999 | Brown |
| 6,018,199 | A | | 1/2000 | Shiroyama et al. |
| 6,020,716 | A | * | 2/2000 | Dunn ..... 320/105 |
| 6,034,492 | A | | 3/2000 | Saito et al. |
| 6,057,667 | A | | 5/2000 | Mills |
| 6,075,331 | A | | 6/2000 | Ando et al. |
| 6,130,519 | A | | 10/2000 | Whiting et al. |
| 6,133,645 | A | | 10/2000 | Scribner et al. |
| 6,160,373 | A | | 12/2000 | Dunn et al. |
| 6,163,088 | A | | 12/2000 | Codina et al. |
| 6,211,577 | B1 | | 4/2001 | Alksnat et al. |
| 6,212,054 | B1 | | 4/2001 | Chan |
| 6,222,342 | B1 | | 4/2001 | Eggert et al. |
| 6,242,887 | B1 | | 6/2001 | Burke |
| 6,265,851 | B1 | | 7/2001 | Brien et al. |
| 6,325,035 | B1 | | 12/2001 | Codina et al. |
| 6,362,595 | B1 | | 3/2002 | Burke |
| 6,426,606 | B1 | | 7/2002 | Purkey |
| 2001/0025618 | A1 | | 10/2001 | Kelling |
| 2003/0222501 | A1 | | 12/2003 | Burke |

OTHER PUBLICATIONS

Translation of Japanese Patent Application No. JP 2-175251, published Jul. 6, 1990.

Miller, et al., SAE Technical Paper Series 982794 entitled "Truck Starting Using Electrochemical Capacitors," copyrighted 1998, pp. 1-7.

John R. Miller, "Engineering Battery-Capacitor Combinations in High Power Applications; Diesel Engine Starting," presented at "The 9th International Seminar on Double Layer Capacitors and Similar Energy Storage Devices", Deerfield Beach, Florida, pp. 1-11, Dec. 6-8,1999.

"KAPower Super Capacitors," Kold-Ban International, Ltd., brochures, pp. 1-4, 2000.

KBI KAPower™ "Installation-Operation Manual," KBi/Kold-Ban International, Ltd., KBI Form #131137 Rev. Jun. 2000, pp. 1-11, 2000.

"Battery Optimizer," brochure, Purkey's Fleet Electric Inc., 1999.

"Low Voltage Disconnects Switches & Alarms—Intelligent Battery Saving Devices," SP Sure Power Industries, Inc., brochure, pp. 1-2, 1998.

"The Intra Switch," http://www.intra-usa.com/intra-switch.html, IntraUSA, 1998.

Charge All Wheel Type Batrtery Chargers (Model 13,-012 Boos All, Good All Mfg., 1999).

U.S. Appl. No. 09/838,005, filed Apr. 18, 2001, Inventor: Burke.

KBi, "KBi Kranking Kap Super Capacitors," KBi Publication, 2 pages, 2000.

KBI, "KrankingKart Professional Jump-Start Unit," obtained at the internet address: http://www.koldban.com/mainpages/karts.htm, 3 pages, Aug. 30, 2001.

Capacitor Log, May 15, 2002, Kold Ban Intl. Ltd.

* cited by examiner

METHODS FOR STARTING AN INTERNAL COMBUSTION ENGINE

This application is a continuation of U.S. patent application Ser. No. 10/278,524, filed Oct. 23, 2002 now abandoned, which is a continuation of U.S. patent application Ser. No. 09/652,686, filed Aug. 31, 2000 now abandoned, the entire disclosures of which are incorporated herein by reference.

BACKGROUND

This invention relates to methods for starting an internal combustion engine, such as the engine of a vehicle, and in particular to methods that can be used quickly and reliably to start such engines.

In the past, it has been common practice to use a portable battery charger to start the engine of a vehicle in cases where the battery of the vehicle has insufficient charge to start the engine. Such battery chargers include a portable battery, cables for connecting the portable battery to the vehicle battery, and a battery charger for charging the portable battery. Conventional batteries have a high internal resistance, especially at low battery temperatures. This high resistance limits the rate at which conventional batteries can be charged and limits the maximum amperage that the battery can supply.

A need presently exists for an improved system that can be used to start internal combustion engines quickly, even at low temperatures.

SUMMARY

The preferred methods described below use a capacitor to start an internal combustion engine. In one method, an internal combustion engine of the type that is coupled with an electrical cranking motor that is in turn coupled with an electrical battery is started with a capacitor that initially has insufficient charge to start the engine. At a time when the battery also has insufficient charge to start the engine, the capacitor is charged with the battery, and then the engine is started with power from the capacitor. Because the capacitor has lower internal resistance than the battery, the capacitor can provide higher amperage levels at a given voltage than a conventional battery at the same voltage. For this reason, it is often possible to start the engine, even when neither the capacitor nor the battery initially has adequate charge to start the engine.

In another method described below, a capacitor is connected with the electrical system of a vehicle, the capacitor is charged with this electrical system, and then the capacitor is disconnected from the vehicle and connected with the cranking motor of the engine to be started. This engine is then started using the associated cranking motor and capacitor. In this way, a single capacitor can be used to start a fleet of vehicles, even though some or all do not have adequate charge in their respective batteries for engine starting purposes.

This section has been provided by way of general introduction, and it is not intended to limit the scope of the following claims.

DETAILED DESCRIPTION OF THE PRESENTLY PREFERRED EMBODIMENTS

Figure 1:
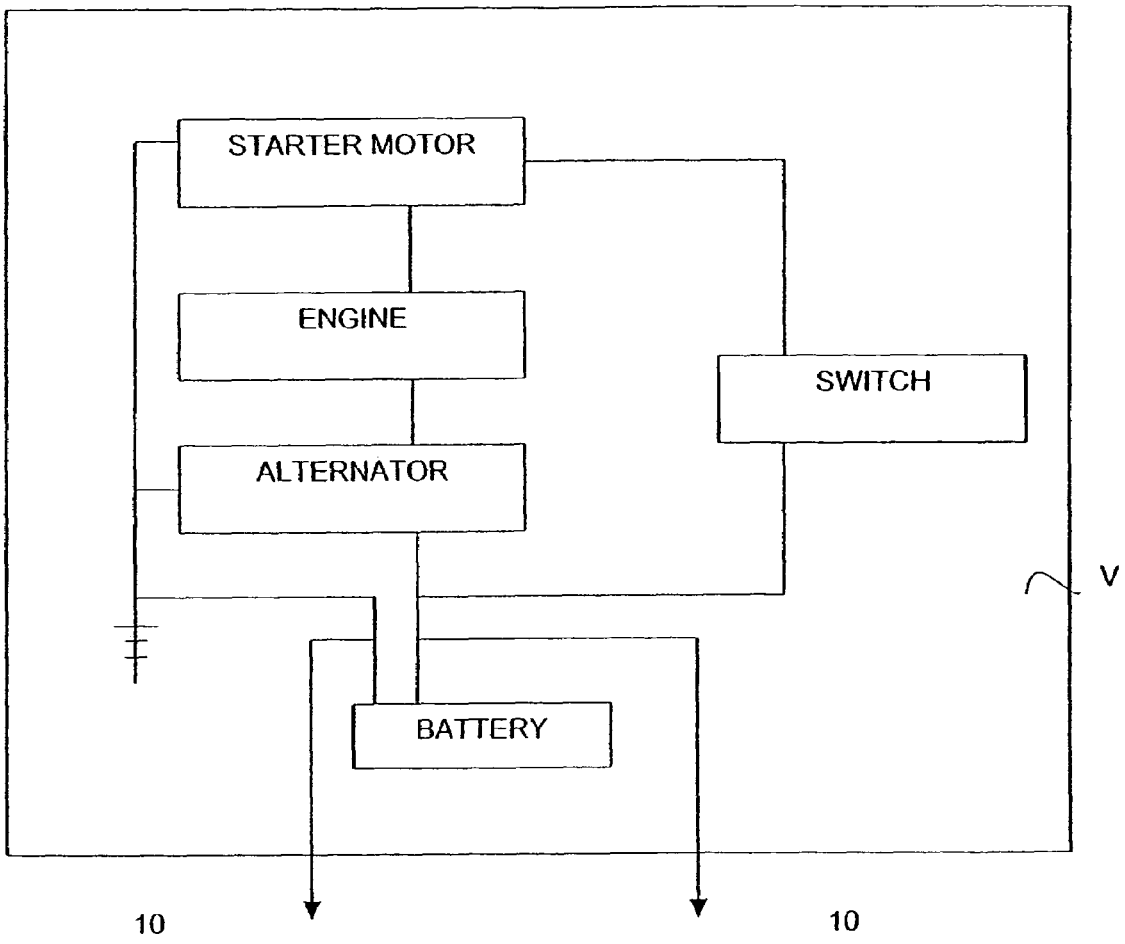
FIG. 1 is a block diagram of a vehicle and selected portions of the electrical system of the vehicle.

Turning now to the drawings, FIG. 1 shows a block diagram of a vehicle V that includes an internal combustion engine such as a diesel engine. The engine drives an alternator that charges a battery. During normal operation, when it is desired to start the engine, a switch is closed, and power from the battery is applied to a cranking motor that cranks the engine. In the event the voltage of the battery is too low for the currently prevailing conditions, the battery may not be able to provide sufficient current to the cranking motor to start the engine.

As shown in FIG. 1, two auxiliary cables are connected to the terminals of the battery, and these auxiliary cables terminate in high amperage connectors 10. The connectors 10 can take any suitable form, as long as they are capable of conducting high currents (for example 400 amperes) at a low resistance. For example, connectors of the type distributed by Crouse Hinds as model number E-Z 1016 can be used.

Figure 2:
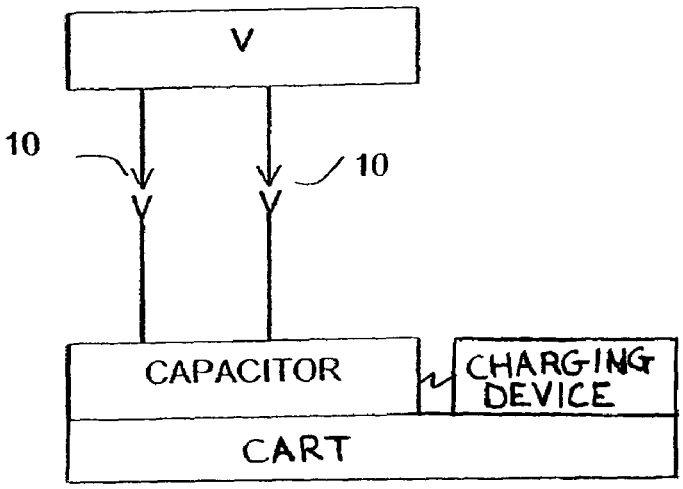
FIG. 2 is a schematic diagram of the vehicle of FIG. 1 connected with a capacitor.

In the methods described below, the electrical system of a vehicle such as the vehicle V is connected with a capacitor C, as shown in FIG. 2. The capacitor C is preferably a large capacitor that stores sufficient power to start the internal combustion engine of the vehicle. In general, the capacitor should have a capacitance greater than 320 farads and an internal resistance at 1 kHz and 20° C. that is preferably less than 0.008 ohms, more preferably less than 0.006 ohms, and most preferably less than 0.003 ohms. Suitable capacitors are distributed by Kold Ban International, Lake in the Hills, Ill., under the trade names KAPower and Kranking Kap. Such capacitors can for example have a nominal working voltage of 12 volts, a maximum voltage of 15 volts, a full energy storage capacity of not less than 50 kJ, a capacitance of 695 farads, an internal resistance at 1 kHz of no more than 0.001 ohms, and a discharge current of 1800 amps. The capacitor C is provided with cables and connectors configured to mate with the connectors 10 described above.

Figure 3:
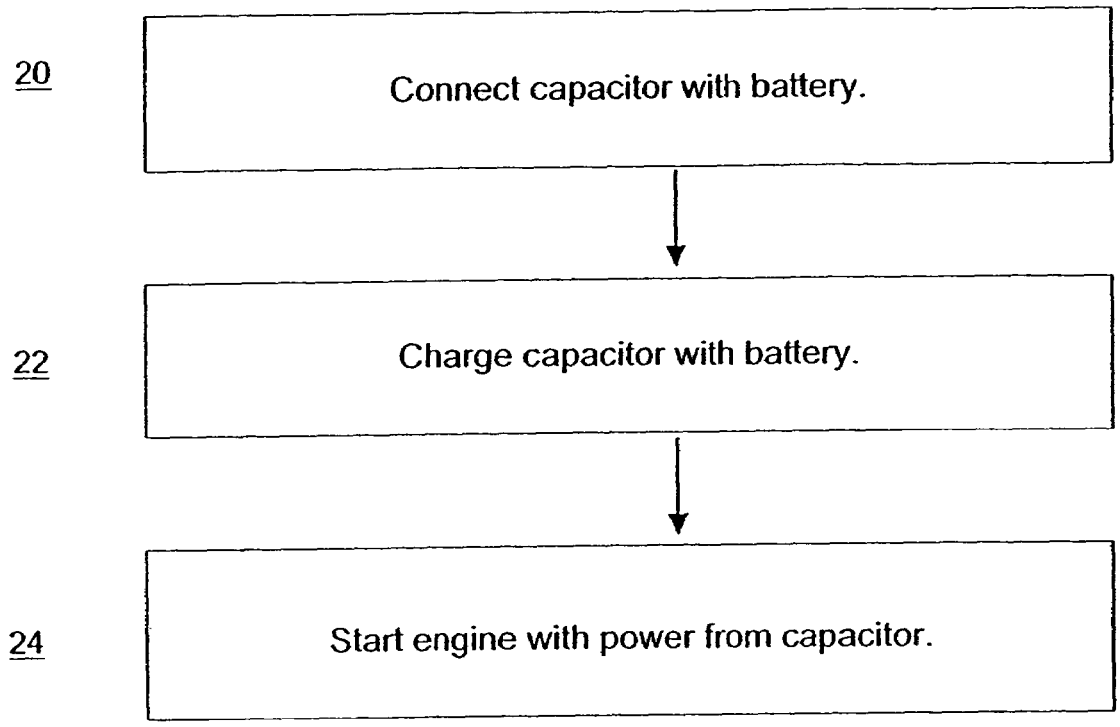
FIG. 3 is a flowchart of a method for starting an internal combustion engine.

In the method of FIG. 3, the capacitor C is connected with the battery of the vehicle V. This is accomplished by mating the associated connectors. Prior to this connection, neither the capacitor C nor the battery has sufficient charge to start the engine of the vehicle V.

Next, in block 22, the capacitor is charged with the battery. This charging takes a very short time, e.g., a few seconds, because of the extremely low internal resistance of the capacitor.

Next, in block 24, the engine of the vehicle V is started using power from the capacitor. Note that prior to the connection of block 22, neither the capacitor nor the battery has sufficient power to start the internal combustion engine. For example, the battery may be at a voltage of 10 volts, which is too low for the battery to supply sufficient current to the cranking motor given the relatively high internal resistance of the battery. However, once the battery is used to charge the capacitor, for example to a voltage of 10 volts, the capacitor is able to start the internal combustion engine. This is because of the extremely low internal resistance of the capacitor.

The method of FIG. 3 provides the important advantage that in many cases the engine of the vehicle can be started, even when no auxiliary power is available, as for example AC power conventionally used to power a battery charger.

Figure 4:
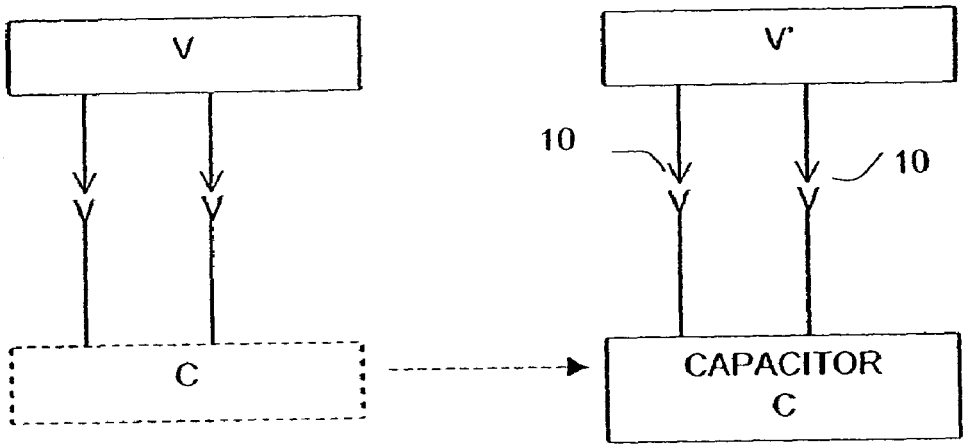
FIG. 4 is a block diagram showing a capacitor being moved from a first vehicle to a second vehicle.
Figure 5:
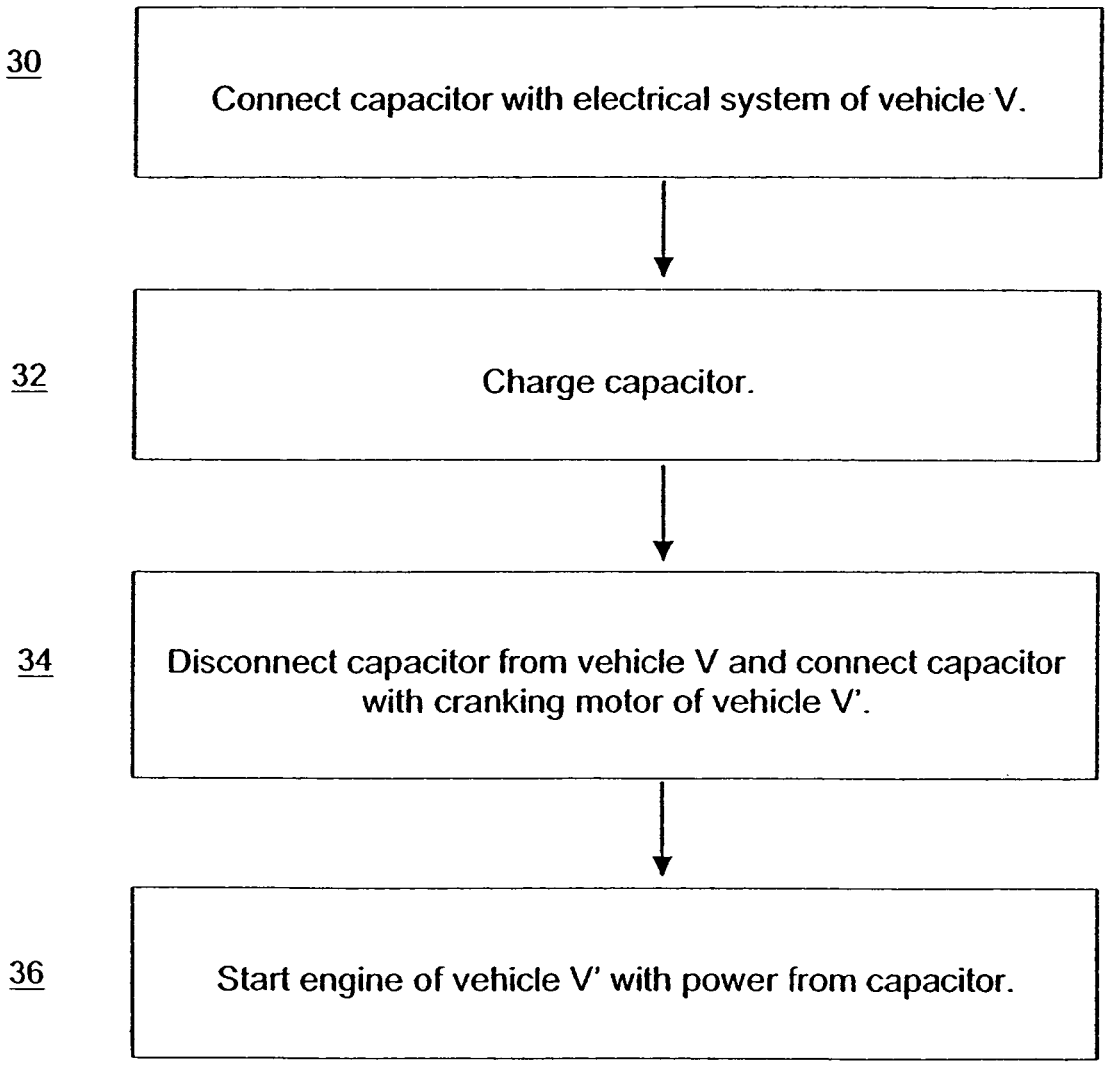
FIG. 5 is a flowchart of another method for starting an internal combustion engine.

In another alternative shown in FIG. 4, the capacitor can first be connected to the electrical system of one vehicle V, and then the capacitor can be disconnected from the vehicle V and connected to another vehicle V'. The capacitor can then be used to start the internal combustion engine of the vehicle V'. FIG. 5 illustrates a starting method of this type.

In block 30 of FIG. 5, the capacitor is connected with the electrical system of the vehicle V, and the capacitor is then charged in block 32. The charging act of block 32 can be accomplished whether or not the engine of the vehicle V is running. Next, in block 34, the capacitor is disconnected from the vehicle V and it is connected with the cranking motor of another vehicle V'. In block 36 the engine of the vehicle V' his then started with power from the capacitor.

This method can be repeated again and again to start a large number of vehicles using a single capacitor. A particular advantage of capacitors is that they charge extremely rapidly. This makes it feasible to move a single capacitor from vehicle to vehicle, thereby rapidly starting the engines of a large number of vehicles.

As used herein, the term "battery" is intended broadly to encompass one or more batteries, and the term "coupled with" is intended broadly to encompass two elements that are coupled by a switch that may be open or closed at any given instant. Thus, a battery is said to be coupled with a starter motor, even when a solenoid switch is connected in series between the battery and the starter motor.

It should be apparent from the foregoing that the starting methods described above can be implemented in many ways. For example, a wide variety of capacitors can be used, including capacitors such as those described in the following patent documents: PCT/RU 95/00170, PCT/RU 95/00171, U.S. patent application Ser. No. 09/206,600. The capacitor is preferably mounted externally of the vehicle, and as shown in FIG. 2, the capacitor may be mounted on a moveable cart, which may include a capacitor charging device normally powered by alternating current. The methods described above can be used with internal combustion engines of any type, whether or not they are included in vehicles.

The foregoing detailed description has described only a few of the many forms that this invention can take. For this reason, this detailed description is intended by way of illustration, and not limitation. It is only the following claims, including all equivalents, that are intended to define the scope of this invention.

What is claimed is:

1. A method for starting one internal combustion engine, said one engine coupled with a cranking motor, said cranking motor coupled with an electrical battery, said method comprising:

(a) connecting a capacitor with an electrical system of another engine while said capacitor is disconnected from said cranking motor coupled with said one engine, wherein said capacitor is mounted on a cart; then (b) charging the capacitor with said electrical system of said another engine; then (c) at a time when said electrical battery has insufficient charge to start said one engine, disconnecting said capacitor from said electrical system of said another engine and connecting said capacitor with said cranking motor coupled with said one engine; then (d) starting said one engine with said cranking motor and said capacitor; and (e) moving said cart with said capacitor.

2. The method of claim 1 wherein said capacitor is characterized by a capacitance greater than 320 farads.

3. The method of claim 2 wherein said capacitor is further characterized by an internal resistance at 1 kHz and 20° C. that is less than about 0.008 ohms.

4. The method of claim 2 wherein the capacitor is characterized by an internal resistance at 1 kHz and 20° C. that is less than about 0.006 ohms.

5. The method of claim 2 wherein the capacitor is characterized by an internal resistance at 1 kHz and 20° C. that is less than about 0.003 ohms.

6. A method for starting an internal combustion engine, said engine coupled with a cranking motor, said cranking motor coupled with an electrical battery, said method comprising:

(a) charging a portable capacitor with a charging device powered by alternating current, wherein said capacitor and said charging device are supported on a cart; then (b) at a time when the battery has insufficient charge to start said engine, temporarily connecting said capacitor with said cranking motor coupled with said engine; then (d) starting said engine with said cranking motor and said capacitor; then (e) disconnecting said capacitor from said cranking motor; and (f) moving said cart with said capacitor and said charging device.

7. The method of claim 6 wherein said capacitor is characterized by a capacitance greater than 320 farads.

8. The method of claim 7 wherein said capacitor is further characterized by an internal resistance at 1 kHz and 20° C. that is less than about 0.008 ohms.

9. The method of claim 7 wherein the capacitor is characterized by an internal resistance at 1 kHz and 20° C. that is less than about 0.006 ohms.

10. The method of claim 7 wherein the capacitor is characterized by an internal resistance at 1 kHz and 20° C. that is less than about 0.003 ohms.

11. A portable rapid-delivery power supply apparatus for providing a supplementary source of power to an electrical system coupled to an internal combustion engine comprising:

a capacitor having connectors adapted to be connected to the electrical system;

a charging device coupled to said capacitor, wherein said charging device is powered by alternating current; and a cart, wherein said capacitor and said charging device are mounted on said cart.

12. The apparatus of claim 11 wherein said capacitor is characterized by a capacitance greater than 320 farads.

13. The apparatus of claim 12 wherein said capacitor is further characterized by an internal resistance at 1 kHz and 20° C. that is less than about 0.008 ohms.

14. The apparatus of claim 11 wherein said connectors comprise a pair of cables.

* * * * *